US008042479B2

(12) United States Patent
Mori

(10) Patent No.: US 8,042,479 B2
(45) Date of Patent: Oct. 25, 2011

(54) SEWING MACHINE

(75) Inventor: Tomohiko Mori, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 855 days.

(21) Appl. No.: 12/081,839

(22) Filed: Apr. 22, 2008

(65) Prior Publication Data

US 2008/0264318 A1 Oct. 30, 2008

(30) Foreign Application Priority Data

Apr. 26, 2007 (JP) ..... 2007-116525

(51) Int. Cl.
*D05B 19/00* (2006.01)

(52) U.S. Cl. ..... 112/470.02

(58) Field of Classification Search ..... 112/475.03, 112/475.06, 315–317, 470.04, 470.02, 475.25
See application file for complete search history.

(56) References Cited

U.S. PATENT DOCUMENTS

| | | | | |
|---|---|---|---|---|
| 4,696,247 | A * | 9/1987 | Horie | 112/315 |
| 4,777,896 | A * | 10/1988 | Nomura | 112/470.03 |
| 5,178,080 | A * | 1/1993 | Nomura et al. | 112/470.06 |
| 5,222,451 | A * | 6/1993 | Akahane et al. | 112/475.03 |
| 6,098,559 | A * | 8/2000 | Hirose | 112/475.19 |
| 6,742,467 | B2 * | 6/2004 | Kong | 112/470.04 |

FOREIGN PATENT DOCUMENTS

| | | |
|---|---|---|
| JP | A-63-150095 | 6/1988 |
| JP | A-63-150096 | 6/1988 |
| JP | A-04-073089 | 3/1992 |
| JP | A-05-049772 | 3/1993 |
| JP | A-09-187586 | 7/1997 |
| JP | B2-2975802 | 11/1999 |

* cited by examiner

*Primary Examiner* — Tejash Patel
(74) *Attorney, Agent, or Firm* — Oliff & Berridge, PLC

(57) ABSTRACT

A sewing machine includes a detection device that detects whether a feed distance by which the piece of work cloth is shifted by a feed dog in the back-and-forth or right-and-left direction has reached a predetermined distance, a counting device that counts a number of forward feed stitches and a number of backward feed stitches which are sewn when the piece of work cloth is shifted backward and forward, respectively, by the predetermined feed distance detected by the detection device or a number of leftward feed stitches and a number of rightward feed stitches which are sewn when the piece of work cloth is shifted leftward and rightward, respectively, by the predetermined feed distance, and a correction value setting device that sets a correction value to correct the feed distance based on a result of the counting of the number of stitches by the counting device.

11 Claims, 9 Drawing Sheets

SEWING MACHINE

CROSS-REFERENCE TO RELATED APPLICATION

The present application claims priority to Japanese Patent Application No. 2007-116525, filed Apr. 26, 2007, the disclosure of which is hereby incorporated by reference in its entirety.

BACKGROUND

The present disclosure generally relates to a sewing machine.

Conventionally, in an electronically-controlled sewing machine, a feed dog that feeds a piece of work cloth is driven by a pulse motor. The pulse motor is controlled based on feed data stored in the sewing machine, thereby feeding the piece of work cloth in a sewing direction. In such a feed mechanism, even when the pulse motor is precisely rotated by a predetermined number of rotations, an error may occur in feeding distance due to a mechanical error or the shape of a presser foot. Such an error in the feeding distance varies according to whether the piece of cloth is fed forward (normal feeding) and backward (reverse feeding), so that finished stitches may be influenced in some patterns. In order to solve this problem, Japanese Patent Application Laid-Open Publication No. Hei 4-73089 proposes an approach for intermittently correcting feed data by mounting a correction key to which a correction amount obtained through trial sewing is set. Japanese Patent Application Laid-Open Publication No. Hei 5-49772 proposes the determination of the type of a stitching pattern prior to correction and it is set such that the correction is not made for a specific pattern, such as a satin stitching, so that a disorder in the stitching may not occur at a corrected portion that would damage the appearance.

However, according to these conventional methods, a correction amount to be employed in correction will be decided by the user through trial sewing and will be determined manually. Determining the correction amount is therefore troublesome and takes a lot of time.

SUMMARY

Various exemplary examples of the broad principles described herein provide a sewing machine that can automatically set a correction value by which a feed distance by a feed dog is to be corrected.

Exemplary examples provide a sewing machine that includes a needle bar that holds a sewing needle and moves up and down as is driven by a drive shaft of the sewing machine, a feed dog that shifts a piece of work cloth in a back-and-forth direction or a right-and-left direction, a feed mechanism that drives the feed dog, a detection device that detects whether a feed distance by which the piece of work cloth is shifted by the feed dog in the back-and-forth or right-and-left directions has reached a predetermined distance, a counting device that counts a number of forward feed stitches and a number of backward feed stitches which are sewn when the piece of work cloth is shifted backward and forward, respectively, by the predetermined feed distance detected by the detection device or a number of leftward feed stitches and a number of rightward feed stitches which are sewn when the piece of work cloth is shifted leftward and rightward, respectively, by the predetermined feed distance, based on up-and-down movement of the needle bar, a correction value setting device that sets a correction value to correct the feed distance by at least one of the forward shift and the backward shift or at least one of the leftward shift and the rightward shift, based on a result of the counting of the number of stitches by the counting device, and a feed controller that controls the feed mechanism in accordance with the correction value set by the correction value setting device.

Exemplary examples also include a sewing machine that includes a needle bar that holds a sewing needle and moves up and down as it is driven by a drive shaft of the sewing machine, a feed dog that shifts a piece of work cloth in a back-and-forth direction or a right-and-left direction, a feed mechanism that drives the feed dog, a detection device that detects whether a feed distance by which the piece of work cloth is shifted by the feed dog in the back-and-forth or right-and-left direction has reached a predetermined distance, a controller that counts a number of forward feed stitches and a number of backward feed stitches which are sewn when the piece of work cloth is shifted backward and forward, respectively, by the predetermined feed distance detected by the detection device or a number of leftward feed stitches and a number of rightward feed stitches which are sewn when the piece of work cloth is shifted leftward and rightward, respectively, by the predetermined feed distance, based on up-and-down movement of the needle bar, and sets a correction value to correct the feed distance by at least one of the forward shift and the backward shift or at least one of the leftward shift and the rightward shift, based on a result of the counting of the number of stitches, and a feed controller that controls the feed mechanism in accordance with the correction value set by the controller.

Exemplary examples also include a computer-readable recording medium that records a program for setting a correction value to correct a feed distance in a sewing machine, the program comprising instructions for detecting whether a feed distance by which a piece of work cloth is shifted by a feed dog in a back-and-forth direction or a right-and-left direction has reached a predetermined distance, instructions for counting a number of forward feed stitches and a number of backward feed stitches which are sewn when the piece of work cloth is shifted backward and forward, respectively, by the detected predetermined feed distance or a number of leftward feed stitches and a number of rightward feed stitches which are sewn when the piece of work cloth is shifted leftward and rightward, respectively, by the predetermined feed distance, based on up-and-down movement of the needle bar, and instructions for setting a correction value to correct the feed distance by at least one of the forward shift and the backward shift or at least one of the leftward shift and the rightward shift, based on a result of the counting.

BRIEF DESCRIPTION OF THE DRAWINGS

Exemplary examples of the disclosure will be described below in detail with reference to the accompanying drawings in which.

DETAILED DESCRIPTION

The following will describe an example of the disclosure with reference to the drawings. First, the physical configuration of a sewing machine 1 will be described below with reference to FIGS. 1-5. It should be noted that in FIG. 1, the side of the paper toward the user is referred to as "front side of the sewing machine 1" and the side away from the user is referred to as "rear side of the sewing machine 1" and the right-and-left direction with respect to FIG. 1 is referred to as "right-and-left direction of the sewing machine 1".

Figure 1:
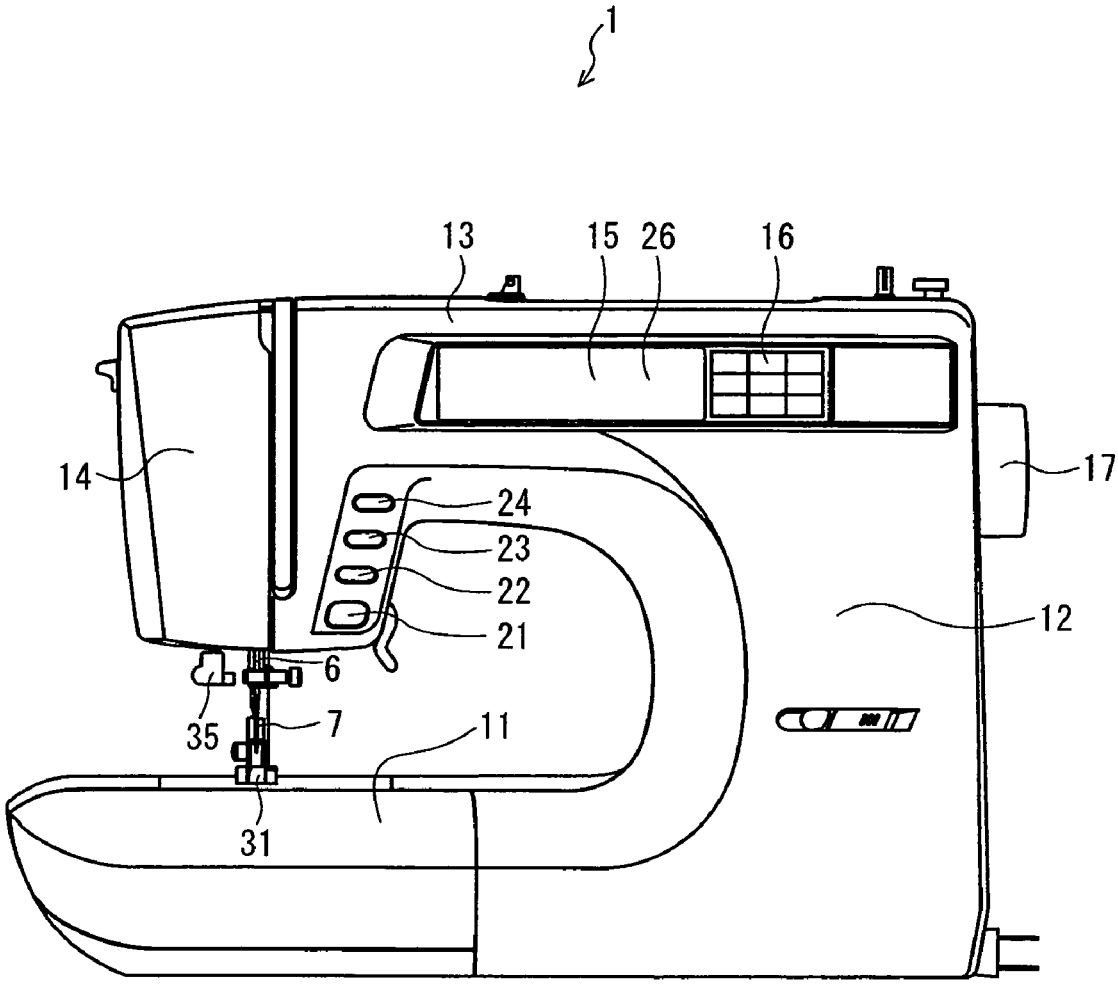
FIG. 1 is a plan view of a sewing machine.

As shown in FIG. 1, the sewing machine 1 has a sewing machine bed 11 which extends in the right-and-left direction, a pillar 12 which is erected upward at the right end of the sewing machine bed 11, an arm 13 which extends leftward from the upper end of the pillar 12, and a head 14 which is provided to the left end of the arm 13. On the front portion of the arm 13, a liquid crystal display (LCD) 15 is mounted which is equipped with a touch panel 26 on its surface. The LCD 15 includes entry keys for entering, for example, a pattern to be sewn and a condition for sewing, etc., in such a configuration that by touching a position on the touch panel 26, corresponding to the indicated entry key, desired patterns to be sewn and conditions for sewing can be selected. On the front surface of the upper end portion of the pillar 12, an operation panel 16 is mounted which has nine function keys on it.

The sewing machine 1 contains a sewing machine motor 91 (see FIG. 6), a drive shaft (not shown), a needle bar 6, and a needle bar up-and-down movement mechanism (not shown), a needle bar swinging mechanism (not shown), a presser bar 38, and a presser elevation mechanism (not shown). The needle bar 6 has a sewing needle attached to its lower end. The needle bar up-and-down movement mechanism is operative to move the needle bar 6 up and down. The needle bar swinging mechanism is operative to swing the needle bar 6 in the right-and-left direction. Attached to the presser bar 38 is a presser foot 31 that is operative to press a piece of work cloth. The presser elevation mechanism is operative to move the presser bar 38 up and down.

The sewing machine bed 11 has a needle plate (not shown) disposed at its upper part. Inside the sewing machine bed 11, three drive mechanisms of a back-and-forth drive mechanism 200 (see FIG. 2), an up-and-down drive mechanism 300 (see FIG. 2), and a lateral feed mechanism 400 (see FIG. 2), are mounted to drive a feed dog 180 (see FIG. 2). The sewing machine bed 11 further contains a shuttle 186 (see FIG. 2), which contains a bobbin thread. The needle plate has a square hole formed such that the feed dog 180 may emerge and protrude from the upper surface of the needle plate, thereby shifting the piece of work cloth in the back-and-forth direction and the right-and-left direction as the back-and-forth drive mechanism 200 and the lateral shift mechanism 400 operate, respectively.

On the front surface of the head 14 switches are equipped, such as a sewing start-and-stop switch 21, a reverse stitch switch 22, a needle up-and-down switch 23, and a thread cutoff switch 24. On the right side surface of the sewing machine 1, a pulley 17 is mounted, which is used to rotate the drive shaft manually so that the needle bar 6 may be moved up and down. If the sewing start-and-stop switch 21 is pressed, the sewing machine motor 91 is driven to start sewing.

Figure 2:
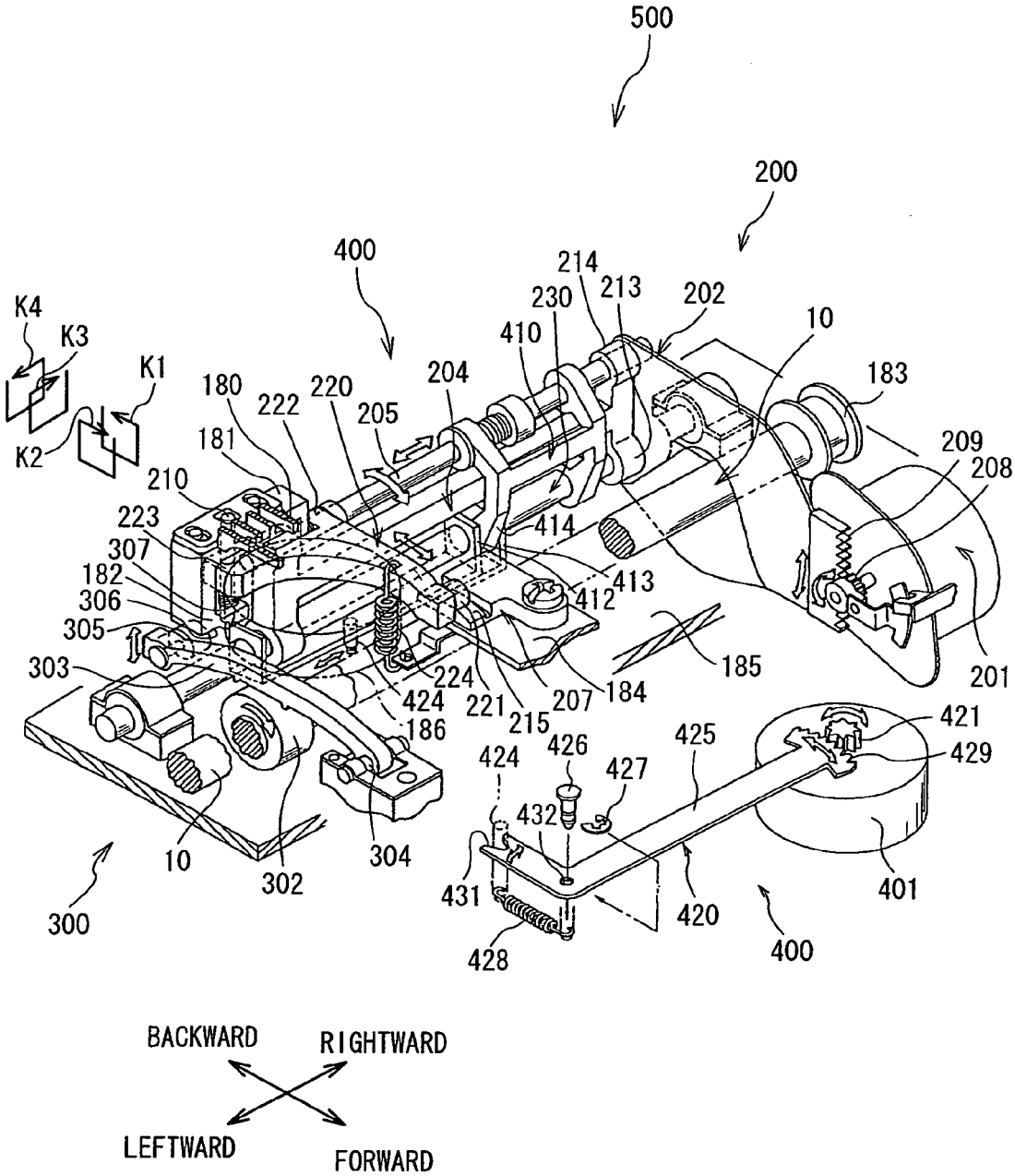
FIG. 2 is a perspective view showing components of a cloth feed mechanism.

Next, the cloth feed mechanism 500 that feeds the piece of work cloth in the back-and-forth and right-and-left directions using the feed dog 180 will be described below with reference to FIG. 2. As shown in FIG. 2, the cloth feed mechanism 500 is equipped with the back-and-forth drive mechanism 200 that moves in the back-and-forth direction, a feed station 181 to which the feed dog 180 is fixed, the up-and-down drive mechanism 300 that moves the feed station 181 in the up-and-down direction, and the lateral feed mechanism 400 that moves the feed station 181 in the right-and-left direction. For the sake of convenience in understanding the disposition of those mechanisms, a dash-and-two-dot line as shown in FIG. 2, indicates the shuttle 186.

As shown in FIG. 2, the back-and-forth drive mechanism 200 has a back-and-forth movement pulse motor 201, an oscillation lever 202, a spindle 230, an oscillation arm 204, a connecting shaft 205, a horizontal feed arm 220, and a feed arm supporting portion 207. The back-and-forth movement pulse motor 201 is independent of the drive system for the drive shaft interlocked with the up-and-down movement of the sewing needle and is driven and controlled by a drive circuit 73 (see FIG. 6) in synchronization with the drive shaft. To the output shaft of the back-and-forth movement pulse motor 201, a drive gear 208 is fixed. The oscillation lever 202 is a plate material having two levers which are bent in a roughly L-shape. The spindle 230 passes through the bent portion so that the oscillation lever 202 may be slidably supported by the spindle 230. Attached to the tip of the lever extending toward the user (toward the right and front side of the drawing), is a driven gear 209 that meshes with the above-described drive gear 208. The pitch circle center of the drive gear 209 is aligned with the shaft center of the spindle 230. The side of the oscillation arm 204 is fixed to a lever extending upward from the bent portion. The oscillation arm 204 is a member that is roughly H-shaped as viewed in elevation plan. At the lower parts of vertical shafts on their right and left sides, bearings 213 are respectively formed, through which the spindle 230 passes through. In such a manner, the oscillation arm 204 is slidably supported by the spindle 230 integrally with the oscillation lever 202.

At the upper part of each of the vertical shafts of the oscillation arm 204, a bearing 214 is formed. The connecting shaft 205 bridges slidably in the right-and-left directions between the bearings 214. A horizontal feed arm 220 supported by the connecting shaft 205 is a thick plate material that is roughly triangle-shaped as viewed in elevation plan. The horizontal feed arm 220 is equipped with a roller 221 on the side of its front end that corresponds to the vertex of the triangle. The horizontal feed arm is equipped with bearings 222 and 223 on the right and left sides of the rear end that corresponds to the base of the triangle. The connecting shaft 205 is inserted halfway into the bearing 222. In such a manner, the horizontal feed arm 220 is supported by the connecting shaft 205 in such a manner that it may swing. A tension spring 224 is stretched between the side surface of the horizontal feed arm 220 and a downward frame 184. The tension spring 224 urges the horizontal feed arm 220 downward so that the roller 221 may always be in close contact with a surface 215 of a later-described feed arm supporting portion 207.

A guide rod 210 is fixed in a condition where it passes through the rear side bearing 223. The shaft line of the guide rod 210 intersects perpendicularly with the plate surface of the horizontal feed arm 220. A portion that protrudes above from the guide rod 210 passes through to the body of the feed station 181 and a portion that protrudes below from it passes through to a guide portion 182 that extends below from the feed station 181. That is, the feed station 181 is supported in a vertically movable manner through the guide rod 210 on the plate surface of the horizontal feed arm 220. The feed arm supporting portion 207 is screwed to a frame 184. The above-described horizontal feed arm 220 is slidably supported on a surface 215 on which the roller 221 slides and moves back and forth in a condition where it is maintained roughly horizontally, as the connecting shaft 205 moves.

Next, the operation of the feed dog 180 will be described below. If the back-and-forth movement pulse motor 201 rotates normally or reversely so that the drive gear 208 may feed the driven gear 209 up and down, respectively, this feeding causes the oscillation lever 202 to oscillate around the spindle 230. Then, the oscillation arm 204 fixed integrally with the oscillation lever 202 oscillates around the spindle 230 in a similar manner. As the oscillation arm 204 oscillates, the connecting shaft 205 reciprocates in the back-and-forth directions. In synchronization with this reciprocation of the connecting shaft 205, the horizontal feed arm 220 bridging between the connecting shaft 205 and the feed arm supporting portion 207 reciprocates in the back-and-forth directions in a condition where it is maintained roughly horizontally. Then, the rear side guide rod 210 moves in the back-and-forth directions the feed station 181 to which the feed dog 180 is anchored.

Next, the up-and-down drive mechanism 300 will be described below. The up-and-down drive mechanism 300 has a lower shaft 10, an eccentric cam 302, and an up-and-down movement lever 303. The lower shaft 10 rotates in synchronization with the drive shaft as a timing belt (not shown) is stretched between a pulley 183 fixed to its right end and a pulley (not shown) fixed to the drive shaft. The eccentric cam 302 is mounted to the lower shaft 10 and rotates integrally with it. The up-and-down movement lever 303 has its front end supported slidably by a rod 304 and also has its belly bottom abut against the eccentric cam 302. A roller 305 is swingablly supported by the side surface of the rear end of the up-and-down movement lever 303. A supporting surface 306 on the bottom face of the feed station 181 is in slidable contact with the roller 305. On the other hand, a compression spring 307 is disposed between the guide portion 182 of the feed station 181 and the horizontal feed arm 220, thereby urging the feed station 181 downward. In such a configuration as described above, the supporting surface 306 is always in close contact with the roller 305 and the up-and-down movement lever 303 is always in close contact with the eccentric cam 302. Therefore, in synchronization with the rotation of the eccentric cam 302, the roller 305 moves up and down, following the feed station 181 which moves up and down.

Next, the lateral feed mechanism 400 will be described below. The lateral feed mechanism 400 is equipped with a right-and-left sliding arm 410 fixed to the connecting shaft 205, a right-and-left movement pulse motor 401, and a right-and-left movement addition mechanism 420. The right-and-left sliding arm 410 is a member that is roughly H-shaped as viewed in elevation plan. The right-and-left sliding arm 410 is guided in the right-and-left direction in a condition where it is slidably supported by the spindle 230. The right-and-left movement pulse motor 401, which is a driving source of the right-and-left sliding arm 410, is mounted to the bottom surface of a frame 185 that constitutes the aforementioned back-and-forth drive mechanism 200 and is driven and controlled in synchronization with the drive shaft. A drive gear 421 is fixed to the output shaft of the right-and-left movement pulse motor 401.

The right-and-left movement addition mechanism 420 has sandwich plates 412 and 413 that sandwich the lower part of the above-described right-and-left sliding arm 410, an actuator pin 424, a horizontal oscillation lever 425, a supporting pin 426, a retaining ring 427, and a tension spring 428. The sandwich plates 412 and 413 sandwich the beating 414 of the right-and-left sliding arm 410. Of these, the sandwich plate 412 has on its lower surface the actuator pin 424 protruding downward. Both ends of the sandwich plate 412 are erected perpendicularly, where the spindle 230 is inserted. As a result, the right end of the sandwich plate 412 abuts against the left end surface that intersects perpendicularly with the axial direction of the spindle 230. Accordingly, the sandwich plate 412 is disposed in parallel with the axial direction of the spindle 230 and as such is guided smoothly without hitting the spindle 230. The other sandwich plate 413, which is a roughly L-shaped member, is screwed to the sandwich plate 412 and is combined with the sandwich plate 412 to sandwich the bearing 414.

The horizontal oscillation lever 425 is a plate material having two levers which are bent in a roughly L-shape and disposed on the bottom side of the frame 185. Out of the two levers, the longer one that extends toward the right-and-left movement pulse motor 401 has a driven gear 429 formed at its tip. The driven gear 429 meshes with a drive gear 421 of the right-and-left movement pulse motor 401. The shorter lever has a notched portion 431 formed at its tip. The actuator pin 424 on the lower surface of the sandwich plate 412 is inserted into the notch of the notched portion 431. The supporting pin 426 is inserted from the above through a hole 432 formed at the bent portion of the horizontal oscillation lever 425. The supporting pin 426 is inserted into the frame 185 through its upper surface and then inserted into the hole 432. The retaining ring 427 is attached on the back side surface of the horizontal oscillation lever 425 in a groove at the upper part of the supporting pin 426. In such a manner, the horizontal oscillation lever 425 is swingablly supported on the bottom surface of the frame 185 through the supporting pin 426.

Next, the operation of the lateral feed mechanism 400 will be described below. When the right-and-left movement pulse motor 401 rotates normally or reversely so that the drive gear 421 may horizontally feed the driven gear 429 forward or backward, respectively, the horizontal oscillation lever 425 oscillates around the supporting pin 426. Then, the short lever at the notched portion 431 reciprocates in the right-and-left directions. The movement of the short lever is transmitted to the actuator pin 424 that is engaged with the notched portion 431. As a result, the sandwich plate 412 mounted to the actuator pin 424 and the sandwich plate 413 screwed to the sandwich plate 412, are guided by the spindle 230 to reciprocate in the right-and-left directions, thereby reciprocating the right-and-left sliding arm 410 in the right-and-left directions. Therefore, the connecting shaft 205 fixed to the right-and-left sliding arm 410 reciprocates in the right-and-left directions as it slides in a condition where it is supported by the oscillation arm 204 of the back-and-forth drive mechanism 200, thereby causing the horizontal feed arm 220 to reciprocate in the right-and-left directions in a similar manner. As a result of the above-described movements of these components, the feed station 181 to which the feed dog 180 is firmly anchored, is guided by the guide rod 210 so as to move in the right-and-left directions.

As described above, the cloth feed mechanism 500 of the sewing machine will operate as follows. In the case of forward feed or backward feed, by rotating the drive gear 208 of the back-and-forth movement pulse motor 201 normally or reversely to feed the driven gear 209 upward or downward, respectively, the feed dog 180 reciprocates in the back-and-forth directions through the connecting shaft 205, the horizontal feed arm 220, or the like. By reciprocating the feed dog 180 in the back-and-forth directions in such a manner as to match the rotational timing (operational timing of the up-and-down drive mechanism 300) of the lower shaft 10, the feed dog 18 follows a forward feed trajectory indicated by arrow K1 or a backward feed trajectory indicated by arrow K2.

On the other hand, in the case of lateral feed, by rotating the drive gear 421 of the right-and-left movement pulse motor 401 normally or reversely, the driven gear 429 is reciprocated in the back-and-forth directions. Then, as described above, the right-and-left sliding arm 410 reciprocates in the right-and-left directions via the horizontal oscillation lever 425, the sandwich plates 412 and 413, or the like. As a result, the connecting shaft 205 reciprocates in the right-and-left directions to reciprocate the feed dog 180 in the right-and-left directions. By reciprocating the feed dog 180 in the right-and-left directions in such a manner as to match the rotational timing of the lower shaft 10, the feed dog 18 follows a rightward feed trajectory indicated by arrow K3 or a leftward feed trajectory indicated by arrow K4.

Figure 3:
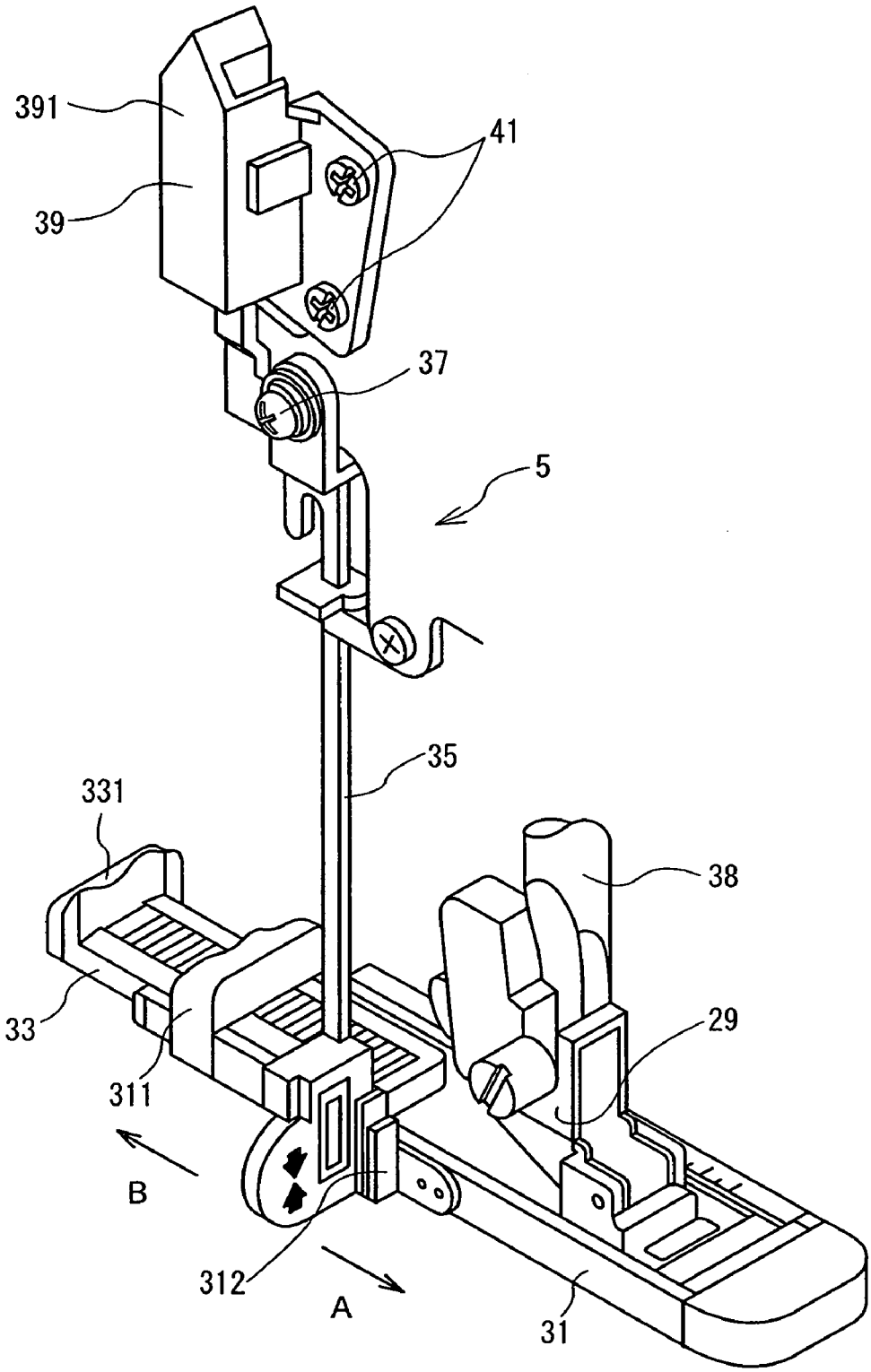
FIG. 3 is a perspective view of a feed distance detection mechanism.
Figure 4:
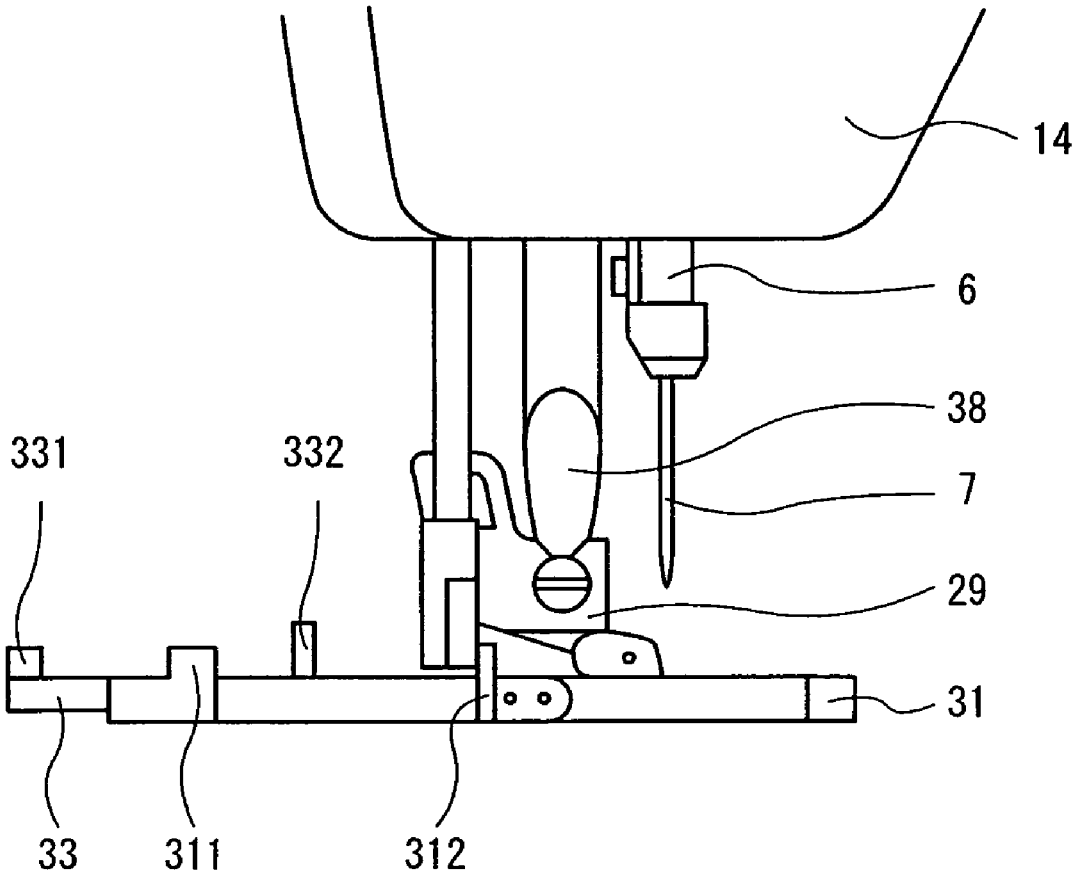
FIG. 4 is a side view of the feed distance detection mechanism.
Figure 5:
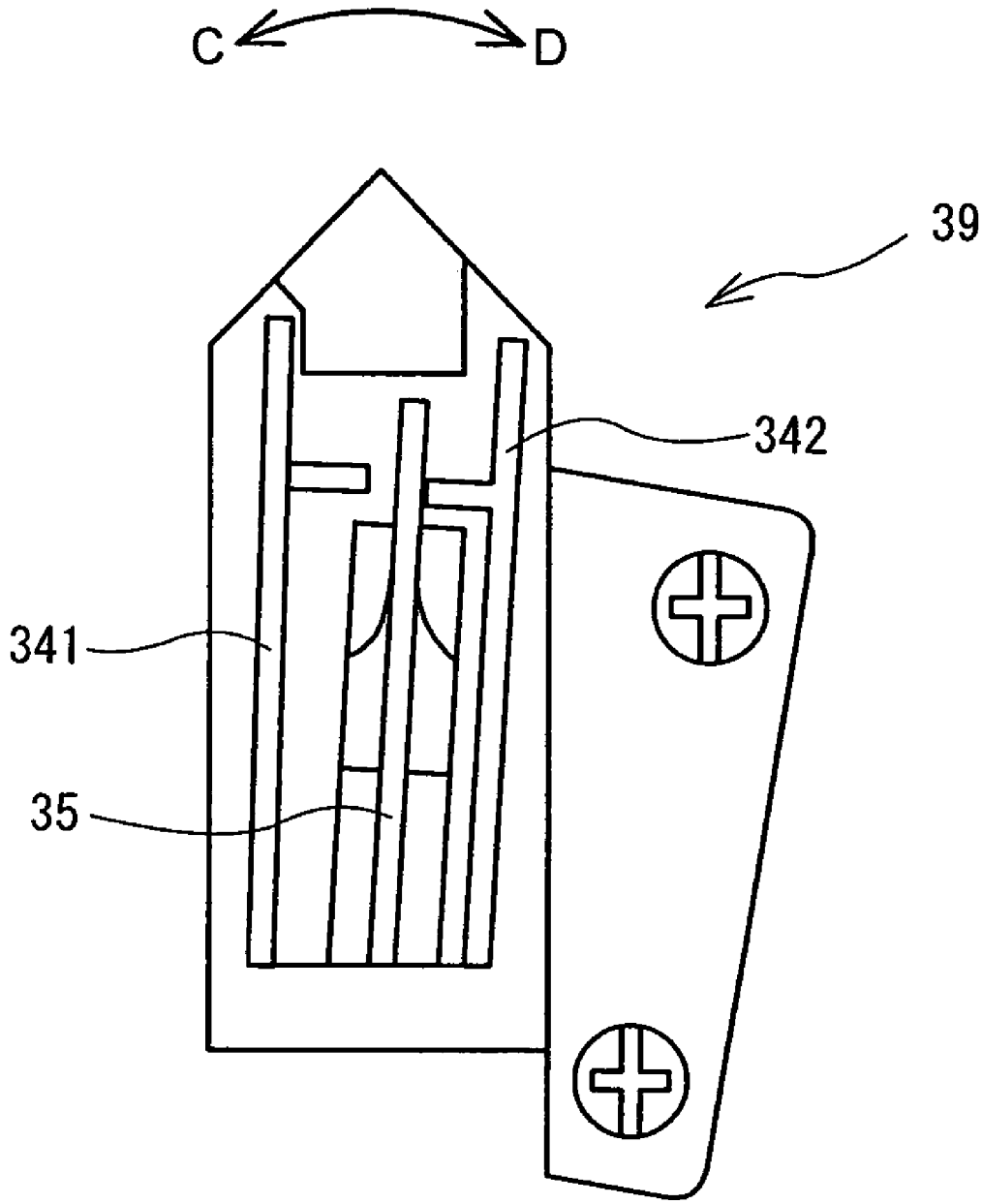
FIG. 5 is an explanatory view showing an interior of a detection switch.

Next, with reference to FIGS. 3-5, a mechanism that detects a feed distance by which the piece of work cloth is shifted by the cloth feed mechanism 500 will be described below, taking for example the case of shifting it in the back-and-forth directions. In the present example, in order to detect forward or backward feeding of a predetermined distance, a mechanism employed in buttonhole stitching is applied. As shown in FIGS. 3 and 4, the feed distance detection mechanism is constituted of a detecting presser 31, a detection lever 35, and a detection switch 5. A cloth presser holder 29 is mounted to the lower part of the presser bar 38. The detecting presser 31 is mounted slidably in the back-and-forth directions to the cloth presser holder 29. At the rear side of the detecting presser 31, a tray station 33 is mounted slidably in the back-and-forth directions with respect to the body of the detecting presser 31.

At the upper part of the rear end of the detecting presser 31 and the upper part of the rear end of the tray station 33, protrusions 311 and 331 are formed, respectively, to move the tray station 33. At the side of the detecting presser 31 and the upper part of the front end of the tray station 33, protrusions 312 and 332 are formed, respectively, to move the detection lever 35. The protrusion 332 formed at the front end of the tray station 33 protrudes from the above towards the side direction.

Further, the detection switch 5 has the detection lever 35, a fulcrum screw 37, and a reversing switch 39. The detection switch 5 is fixed to the head 14 of the sewing machine 1 with a screw 41. The reversing switch 39 includes a first switch 341 and a second switch 342 to move the detection lever 35 as shown in FIG. 5, which illustrates a condition where a cover 391 is detached. The reversing switch 39 is turned ON and OFF in accordance with the movement of the detection lever 35 in the directions of arrows A and B (FIG. 3), respectively.

Next, the operations of the detection switch 5 will be described below. The detection lever 35 is generally housed in the head 14 (see FIG. 1) and pulled out in a downward direction when it is used. Then, the user moves the protrusion 332 by setting the tray station 33 to the position of a mark of a scale (not shown) given to the body of the detecting presser 31. With this, a position is determined at which the detection lever 35 is operated, that is, a sewing direction is reversed. Specifically, if the detecting presser 31 moves in the arrow A direction (FIG. 3) as sewing goes on until the detection lever 35 is pressed by the protrusion 332 formed at the front end of the tray station 33, the upper end of the detection lever 35 swings in an arrow C direction (FIG. 5), thereby turning ON the first switch 341. Conversely, if the detecting presser 31 moves in the arrow B direction (FIG. 3) until the detection lever 35 is pressed by the protrusion 312 of the detecting presser 31, the upper end of the detection lever 35 swings in an arrow D direction (FIG. 5), thereby turning ON the second switch 342. In such a manner, a feed distance is detected which is experienced from a point in time when the first switch 341 is turned ON to a point in time when the second switch is turned ON.

Figure 6:
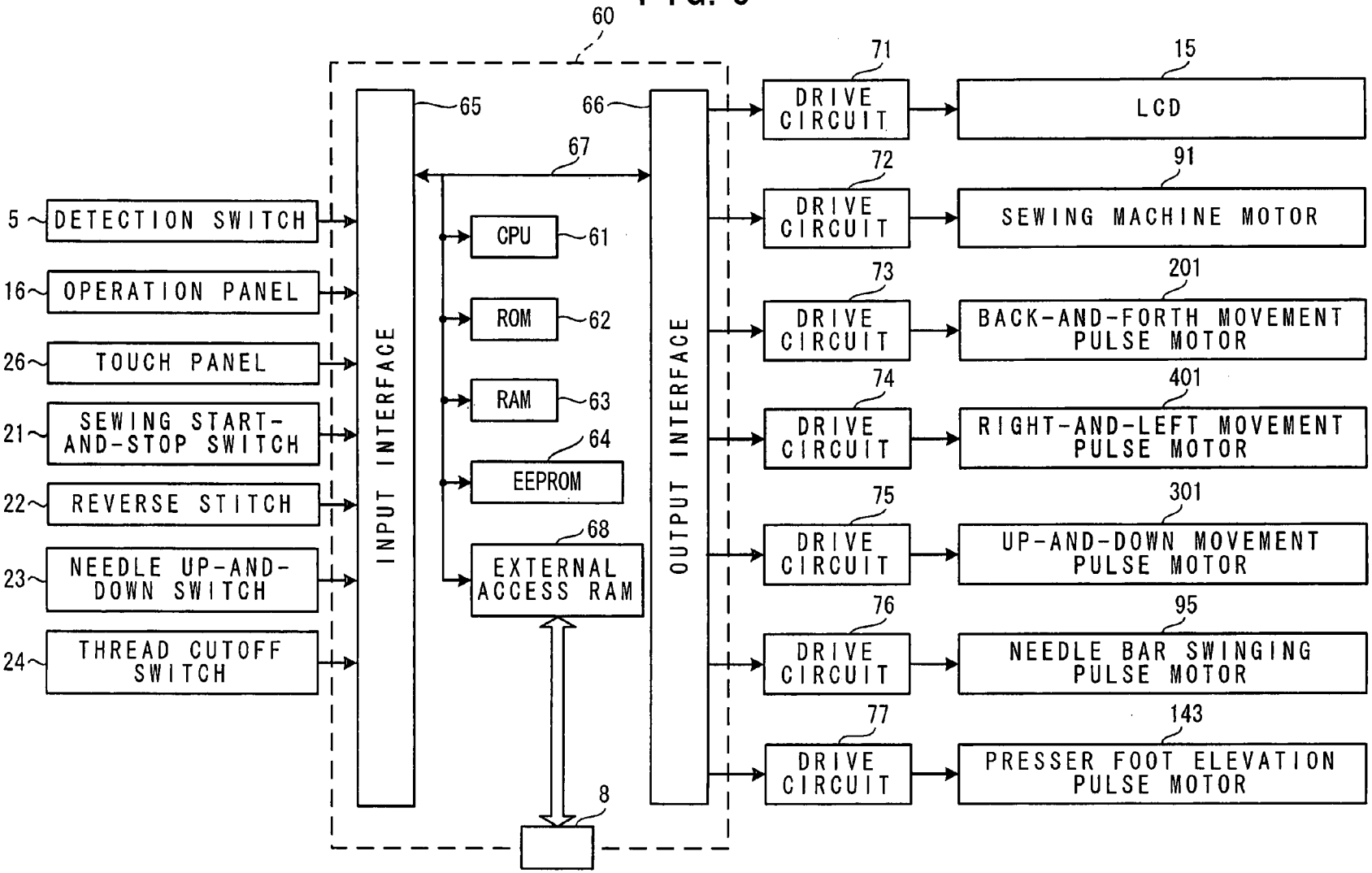
FIG. 6 is a block diagram showing an electrical configuration of the sewing machine.

Next, the electrical configuration of the sewing machine 1 will be described below with reference to FIG. 6. As shown in FIG. 6, a control section 60 of the sewing machine 1 has a CPU 61, a ROM 62, a RAM 63, an EEPROM 64, a card slot 8, an external access RAM 68, an input interface 65, and an output interface 66, which are connected to each other via a bus 67. To the input interface 65 are connected the detection switch 5, the operation panel 16, the touch panel 26, the sewing start-and-stop switch 21, the reverse stitch switch 22, the needle up-and-down switch 23, and the thread cutoff switch 24.

Drive circuits 71-77 are electrically connected to the output interface 66. The drive circuit 71 is operative to drive the LCD 15. The drive circuit 72 is operative to drive the sewing machine motor 91, which rotates the drive shaft. The drive circuit 73 is operative to drive the back-and-forth movement pulse motor 201, which moves the feed dog 180 in the back-and-forth directions. The drive circuit 74 is operative to drive the right-and-left movement pulse motor 401, which moves the feed dog 180 in the right-and-left directions. The drive circuit 75 is operative to drive the up-and-down movement pulse motor 301, which moves the feed dog 180 in the up-and-down directions. The drive circuit 76 is operative to drive a needle bar swinging pulse motor 95, which drives the needle bar 6 by oscillating the needle bar 6. The drive circuit 77 is operative to drive a presser foot elevation pulse motor 143, which elevates the presser bar 38.

In the ROM 62, which is a read only memory, a control program for controlling the sewing machine 1 may be stored. The CPU 61 conducts main control over the sewing machine 1, to perform various kinds of operations and processing in accordance with the control program stored in the ROM 62. The RAM 63, which is a random access memory, has a variety of storage regions as necessary in which to store a result of the operations performed by the CPU 61.

Figure 8:
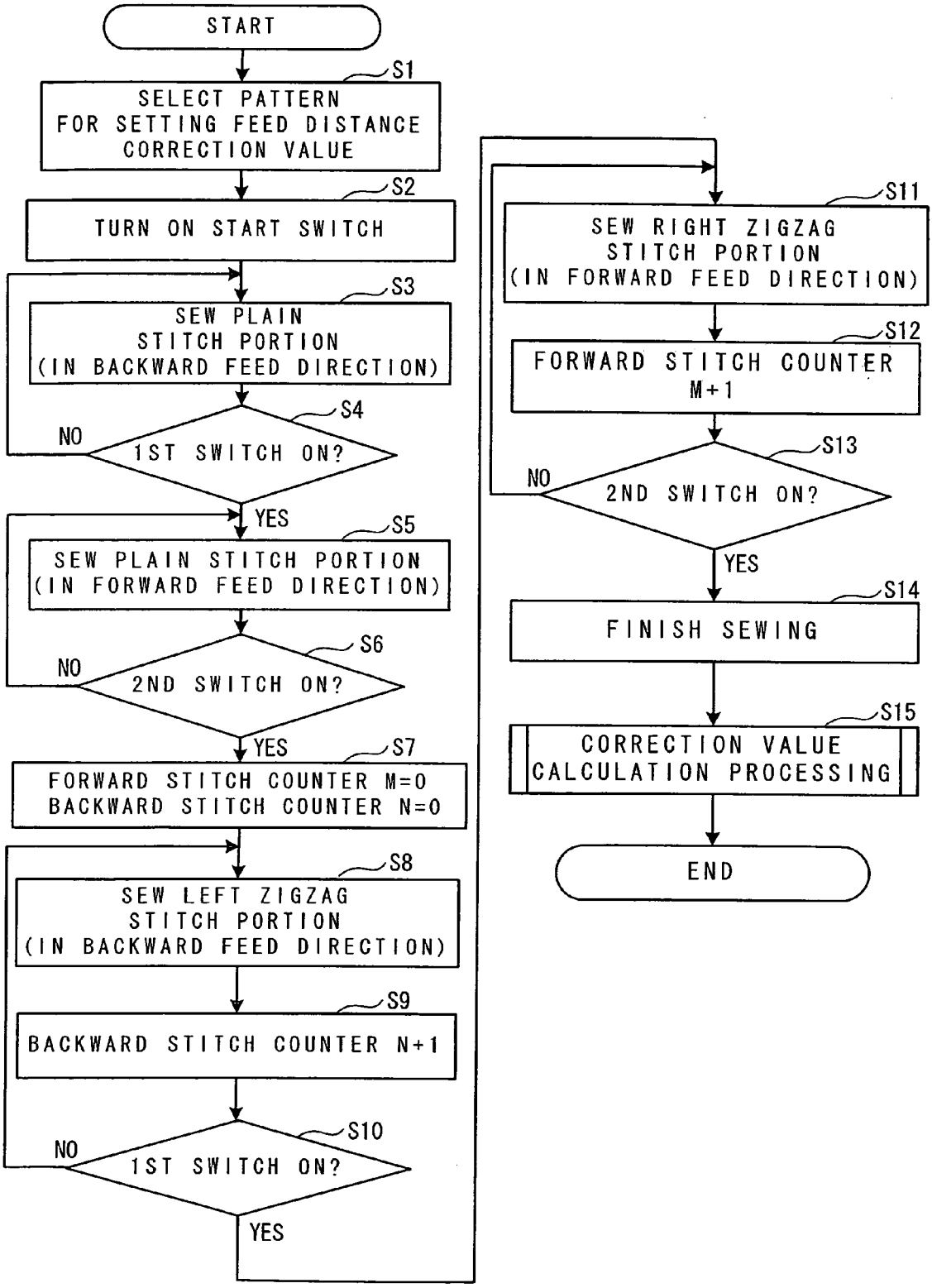
FIG. 8 is a flowchart of correction value setting processing.
Figure 9:
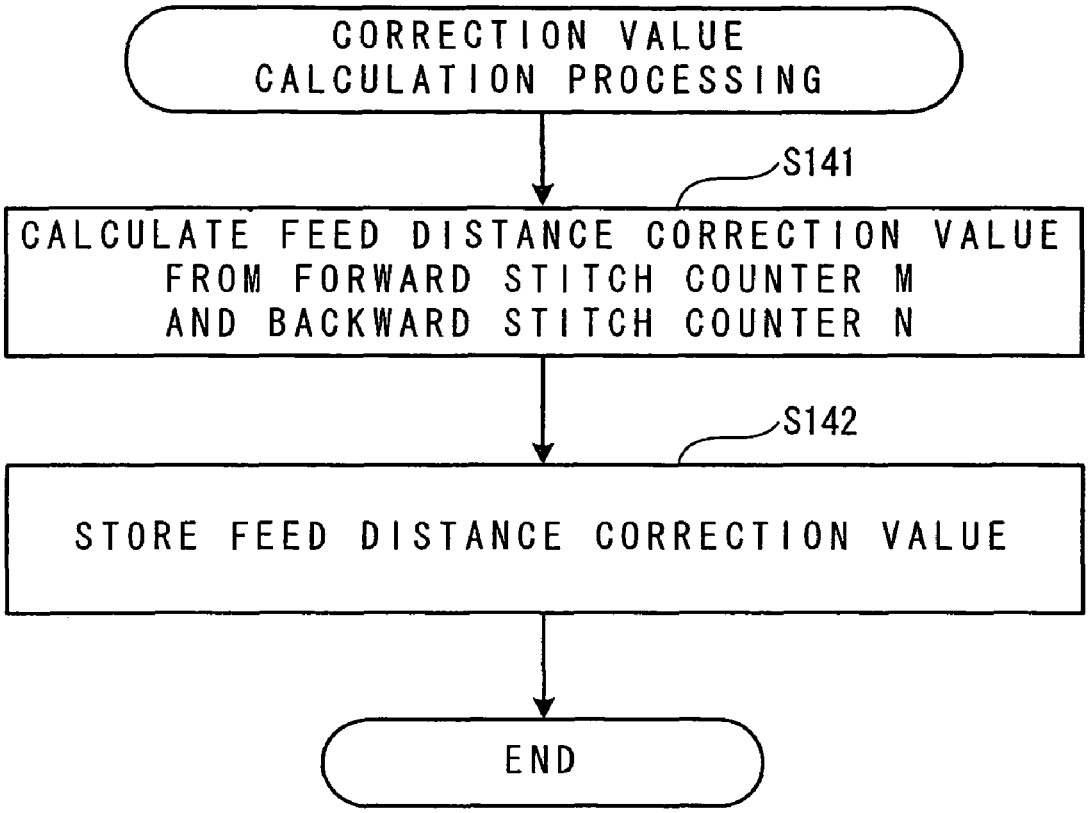
FIG. 9 is a flowchart of correction value calculation processing that is performed in the correction value setting processing.

Next, the process to set a feed distance correction value for correcting a feed distance of the feed dog 180 in the thus constituted sewing machine 1 will be described below with reference to FIGS. 7-9. The following example will describe the setting of a correction value in a case where there is a difference between a forward feed distance and a backward feed distance. In this process, zigzag stitches will be sewn through forward feeding and backward feeding over a predetermined feed distance detected by the feed distance detection mechanism, to count the numbers of the forward and backward stitches, respectively, and calculate a difference between them, thus setting such a correction value as to reduce the difference to zero.

The correction value setting process starts if a setting menu indicated on the LCD 15 is selected trough the touch panel 26. First, a pattern for setting a feed distance correction value is selected in step 1 (S1). Next, the sewing start-and-stop switch 21 is turned ON in step 2 (S2). Then, plain sewing is performed to detect a feed distance. The plain stitches will be sewn in a backward feed direction first and then in a forward feed direction.

Figure 7:
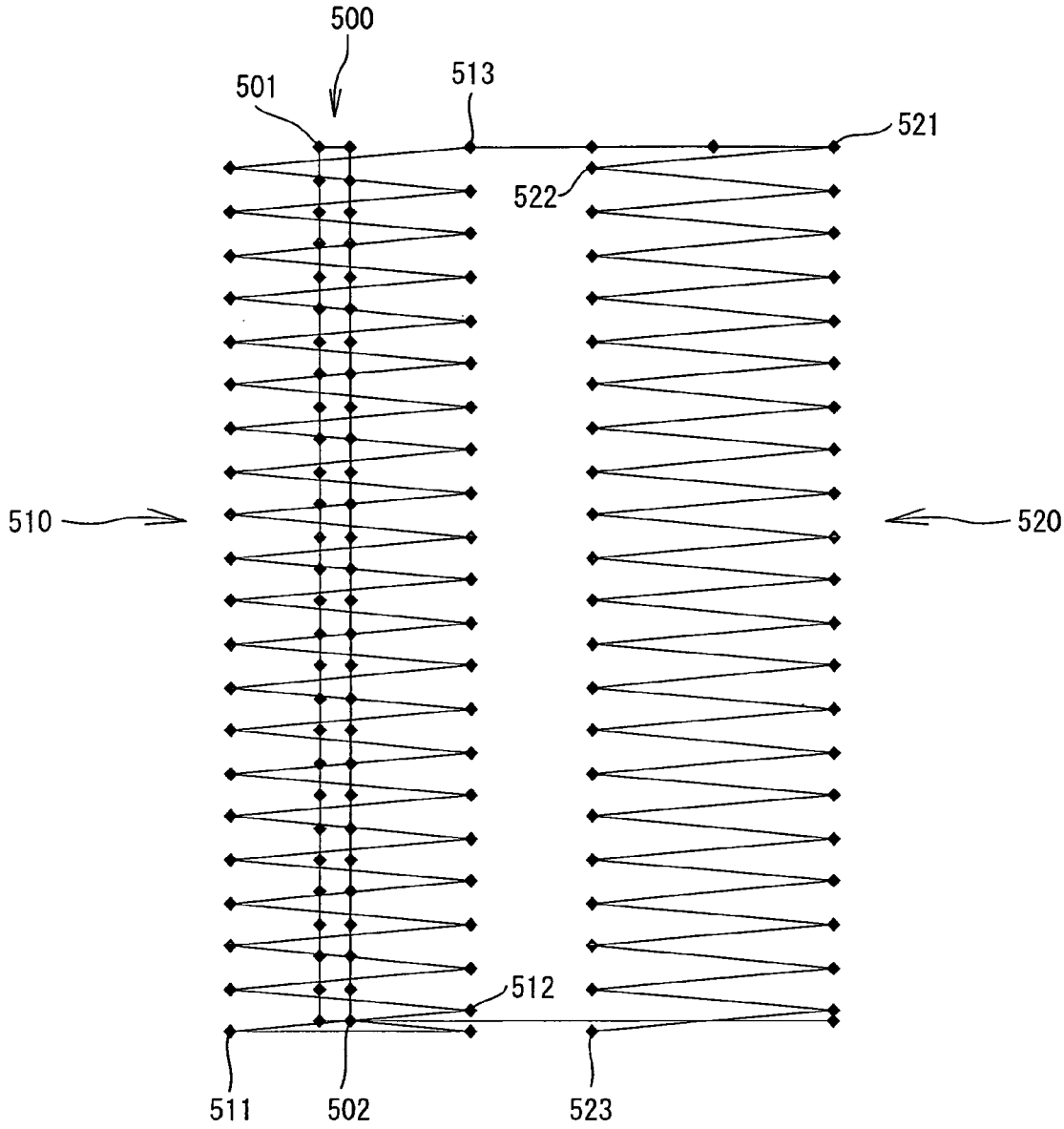
FIG. 7 is an explanatory view showing an example of sewing a preset pattern for feed distance correction.

Specifically, the process performs sewing of such a plain stitch portion 500 as shown in FIG. 7 in the backward feed direction in step 3 (S3). Next, the process determines whether or not the first switch 341 is turned ON in step 4 (S4). As aforementioned, if the detection lever 35 is pressed by the protrusion 332 formed at the front end of the tray station 33, the upper end of the detection lever 35 swings in the arrow C direction (FIG. 5) to turn it ON. That is, the process detects a position at which the sewing direction is reversed. In a sewing example shown in FIG. 7, the first switch is turned ON at a needle drop point 501.

If the first switch 341 is not turned ON (NO at S4), the process determines that a reversing position is not encountered. The process returns to S3 and performs sewing of the plain stitch portion 500 in the backward feed direction again. If the first switch 341 is turned ON (YES at S4), the process then performs sewing of the plain stitch portion 500 in the forward feed direction in step 5 (S5). Then, the process determines whether or not the second switch 342 is turned ON in step 6 (S6). In the sewing example of FIG. 7, the second switch 342 is turned ON at a needle drop point 502. As aforementioned, if the detection lever 35 is pressed by the protrusion 312 formed at the detecting presser 31 as the detecting presser 31 moves in the arrow B direction (FIG. 3), the upper end of the detection lever 35 swings in the arrow D direction (FIG. 5) to turn it ON.

If the second switch 342 is not turned ON (NO at S6), the process decides that a reversing position is not encountered. The process returns to S5 and performs sewing of the plain stitch portion 500 in the forward feed direction again. If the second switch 342 is turned ON (YES at S6), detection of a feed distance for the purpose of counting the number of stitches is completed.

Then, as a detected feed distance is sent, the process counts the numbers of forward stitches and backward stitches in the case of zigzag sewing. Specifically, first the process initializes a forward stitch counter M and a backward stitch counter N to "0" in step 7 (S7).

Subsequently, the process sews a left zigzag stitch portion 510 in the backward feed direction in step 8 (S8). Then, by detecting the up-and-down movement of the needle bar 6, the process increments the backward stitch counter N by 1 in step 9 (S9). The process starts sewing the left zigzag stitch portion 510 at a needle drop point 511 and encounters a needle drop point 512 if the backward stitch counter N becomes 1 (=1) as shown in FIG. 7.

Subsequently, the process determines whether or not the first switch 341 is turned ON in step 10 (S10). If the first switch 341 is not turned ON (NO at S10), the process determines that a reversing position is not encountered. The process returns to S8 and performs sewing of the left zigzag potion 510 in the backward feed direction again. In such a manner, the process repeats the sewing (S8) and the incrementing of the backward stitch counter N (S9) until the first switch 341 is turned ON. The first switch 341 is turned ON if a needle drop point 513 in FIG. 7 is encountered.

If the first switch 341 is turned ON (YES at S10), the process moves from the needle drop point 513 to a needle drop point 521. Subsequently, the process sews a right zigzag stitch portion 520 in the forward feed direction in step 11 (S11) to detect the up-and-down movement of the needle bar 6 and increment the forward stitch counter M by 1 in step 12 (S12). If the forward feed counter M becomes 1 (=1), a needle drop point 522 is encountered (FIG. 7).

Then, the process determines whether or not the second switch 342 is turned ON in step 13 (S13). If the second switch 342 is not turned ON (NO at S13), the process decides that a reversing position is not encountered. The process returns to S11 to sew the right zigzag stitch portion 520 in the forward feed direction again. In such a manner, the process repeats the sewing (S11) and the incrementing of the forward stitch counter M (S12) until the second switch 342 is turned ON. The second switch 342 is turned ON if a needle drop point 523 as shown in FIG. 7 is encountered.

If the second switch 342 is turned ON (YES at S13), the process terminates the sewing operation in step 14 (S14). In such a manner, the above processing of S3 through S13 counts the numbers of stitches in forward zigzag sewing and backward zigzag sewing, respectively, over a feed distance detected through plain stitch sewing.

Then, the process performs correction value calculation processing to calculate a feed distance correction value based on the values of the respective forward stitch counter M and the backward stitch counter N in step 15 (S15).

The correction value calculation processing will be described below with reference to FIG. 9. First, the process calculates a feed distance correction value H from values of the respective forward stitch counter M and the backward stitch counter N in step 141 (S141). The feed distance correction value H is calculated by the following equation, assuming that a forward stitch count is M, a backward stitch count is N, and one of those M and N whichever smaller is L:

$$H=(N-M)\times\alpha/L$$

where, $\alpha$ is a fixed value that depends on the rotation of the back-and-forth movement pulse motor 201. Taking into account characteristics inherent to each of the sewing machines 1, a fixed value $\beta$ may be added to or subtracted from the above equation.

For example, assume $\alpha=20$ to establish such a design value as to feed the piece of cloth with 50 stitches per 20 mm. If the forward stitch counter M=45 and the backward stitch counter N=55, L=45 is given resultantly, the following relationship is established:

$$H=(55-45)\times 20/45=4 \text{ (fractional parts discarded)}$$

For example, assume that a correction value of 1 corresponds to correction of one pulse being increased per 10 stitches each time. If H is four (4), the process performs correction of increasing four pulses per ten stitches in four times. In this case, the process performs such correction as to increase (improve a feed efficiency) the feed distance for a larger number of stitches (lower feed efficiency).

Next, the process stores the calculated correction value H into the RAM 63 and the EEPROM 68 in step 16 (S16). It is thus possible to invoke a preset correction value from the RAM 63 for use in the correction of a feed distance in the subsequent sewing. Further, to turn off the power supply and then turn it on to perform sewing, a correction value can be invoked from the EEPROM 68 to correct a feed distance. After storing it, the process returns to the correction value setting processing to finish the entirety of the processing.

As described above, in the sewing machine 1 of the present example, a feed distance correction value setting pattern is prepared which is composed of plain stitches for detecting a feed distance and zigzag stitches for counting the number of stitches. To detect a feed distance, the detecting presser 31 is used to which a buttonhole presser is applied. First, the process detects a feed distance through sewing of a plain stitch pattern and sews zigzag stitches through backward and forward feeding over this feed distance, thereby counting the respective numbers of stitches. The process calculates a correction value by using a difference between those stitch counts, stores it, and corrects a feed distance. Therefore, the user does not need to perform the correction manually. Only by performing sewing of a preset pattern, a correction value is set automatically to correct an error in the back-and-forth directions, thereby securing an appropriate feed distance.

The configuration of the sewing machine 1 described in the present example is just one example and, of course, it can be modified variously. For example, similar to the correction of a back-and-forth directional feed distance, a right-and-left directional feed distance can be corrected. In the case of the right-and-left directional correction, instead of pattern sewing through forward and backward feeding, a pattern is sewn through rightward and leftward feeding. The process can count the numbers of stitches by using a rightward feeding counter and a leftward feeding counter, respectively, and calculate a difference between them to thereby set a correction value.

The above-described example has counted the numbers of stitches in the forward and backward directions and calculated such a correction value as to minimize a difference between them. The present disclosure is not limited to it; the process may count the number of stitches only one of the directions and compare it with a design value to thereby calculate a correction value.

Further, although in the above-described example, to detect a feed distance for a piece of work cloth, the reversing switch 39 and the detection lever 35 which detects the feed distance is utilized in buttonhole sewing, however the present disclosure is not limited to it. For example, an optical sensor or an image sensor may be equipped separately to detect a feed distance for the piece of work cloth in a contact-less manner.

Further, a preset pattern for feed distance correction is not limited to that shown in FIG. 7. For example, rather than of a zigzag sewing pattern, a linear sewing pattern may be employed which is of forward and backward feeding.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a needle bar that holds a sewing needle and moves up and down as it is driven by a drive shaft of the sewing machine;

a feed dog that shifts a piece of work cloth in a back-and-forth direction or a right-and-left direction;

a feed mechanism that drives the feed dog;

a detection device that detects whether a feed distance by which the piece of work cloth is shifted by the feed dog in the back-and-forth or right-and-left direction has reached a predetermined distance;

a counting device that counts a number of forward feed stitches and a number of backward feed stitches which are sewn when the piece of work cloth is shifted backward and forward, respectively, by the predetermined feed distance detected by the detection device or a number of leftward feed stitches and a number of rightward feed stitches which are sewn when the piece of work cloth is shifted leftward and rightward, respectively, by the predetermined feed distance, based on up-and-down movement of the needle bar;

a correction value setting device that sets a correction value to correct the feed distance by at least one of the forward shift and the backward shift or at least one of the leftward shift and the rightward shift, based on a result of the counting of the number of stitches by the counting device; and a feed controller that controls the feed mechanism in accordance with the correction value set by the correction value setting device.

2. The sewing machine according to claim 1, further comprising:

a stitch count difference calculation device that calculates a difference between the number of forward feed stitches and the number of backward feed stitches or a difference between the number of leftward feed stitches and the number of rightward feed stitches which are counted by the counting device, wherein the correction value setting device sets the correction value based on a result of the calculation by the stitch count difference calculation device.

3. The sewing machine according to claim 1, further comprising a storage device that stores the correction value which is set by the correction value setting device.

4. The sewing machine according to claim 1, wherein the detection device has a detection lever and a detection switch that detect the feed distance in buttonhole sewing.

5. A sewing machine comprising:

a needle bar that holds a sewing needle and moves up and down as it is driven by a drive shaft of the sewing machine;

a feed dog that shifts a piece of work cloth in a back-and-forth direction or a right-and-left direction;

a feed mechanism that drives the feed dog;

a detection device that detects whether a feed distance by which the piece of work cloth is shifted by the feed dog in the back-and-forth or right-and-left direction has reached a predetermined distance;

a controller that counts a number of forward feed stitches and a number of backward feed stitches which are sewn when the piece of work cloth is shifted backward and forward, respectively, by the predetermined feed distance detected by the detection device or a number of leftward feed stitches and a number of rightward feed stitches which are sewn when the piece of work cloth is shifted leftward and rightward, respectively, by the predetermined feed distance, based on up-and-down movement of the needle bar, and sets a correction value to correct the feed distance by at least one of the forward shift and the backward shift or at least one of the leftward shift and the rightward shift, based on a result of the counting of the number of stitches; and a feed controller that controls the feed mechanism in accordance with the correction value set by the controller.

6. The sewing machine according to claim 5, wherein the controller calculates a difference between the number of forward feed stitches and the number of backward feed stitches or a difference between the number of leftward feed stitches and the number of rightward feed stitches which are counted.

7. The sewing machine according to claim 5, further comprising a storage device that stores the correction value which is set by the correction value setting device.

8. The sewing machine according to claim 5, wherein the detection device has a detection lever and a detection switch that detect the feed distance in buttonhole sewing.

9. A non-transitory computer-readable recording medium that records a program for setting a correction value to correct a feed distance in a sewing machine, the program comprising:

instructions for detecting whether a feed distance by which a piece of work cloth is shifted by a feed dog in a back-and-forth direction or a right-and-left direction has reached a predetermined distance;

instructions for counting a number of forward feed stitches and a number of backward feed stitches which are sewn when the piece of work cloth is shifted backward and forward, respectively, by the detected predetermined feed distance or a number of leftward feed stitches and a number of rightward feed stitches which are sewn when the piece of work cloth is shifted leftward and rightward, respectively, by the predetermined feed distance, based on up-and-down movement of the needle bar of the sewing machine; and instructions for setting a correction value to correct the feed distance by at least one of the forward shift and the backward shift or at least one of the leftward shift and the rightward shift, based on a result of the counting.

10. The recording medium according to claim 9, wherein the program further comprises instructions for calculating a difference between the number of forward feed stitches and the number of backward feed stitches or a difference between the number of leftward feed stitches and the number of rightward feed stitches which are counted.

11. The recording medium according to claim 9, wherein the program further comprises instructions for storing the set correction value.

* * * * *